United States Patent [19]

Gisbourne

[11] 4,182,381

[45] Jan. 8, 1980

[54] PAPERMAKERS FABRICS

[75] Inventor: Bryan J. Gisbourne, Blackburn, England

[73] Assignee: Scapa-Porritt Limited, Blackburn, England

[21] Appl. No.: 822,668

[22] Filed: Aug. 8, 1977

[30] Foreign Application Priority Data

Aug. 10, 1976 [GB] United Kingdom ..... 33199/76

[51] Int. Cl.[2] ..... D03D 15/00; D21F 1/10; D21F 7/08

[52] U.S. Cl. ..... 139/383 A; 139/425 A; 162/DIG. 1

[58] Field of Search ..... 139/383 A, 425 A, 408–413, 139/425; 28/141; 162/DIG. 1, 348, 358, 359; 245/8, 10

[56] References Cited

U.S. PATENT DOCUMENTS

| | | | |
|---|---|---|---|
| 820,825 | 5/1906 | Sarafian | 139/412 |
| 2,865,409 | 12/1958 | Asten | 139/383 A |
| 2,934,097 | 4/1960 | Hindle et al. | 139/383 A |
| 3,127,308 | 3/1964 | Justus et al. | 139/425 A |
| 3,225,900 | 12/1965 | MacBean et al. | 139/383 A |
| 3,915,202 | 10/1975 | Curtis et al. | 139/425 A |
| 4,026,331 | 5/1977 | Lees et al. | 139/383 A |
| 4,041,989 | 8/1977 | Johansson et al. | 139/425 A |
| 4,112,982 | 9/1978 | Bugge et al. | 139/425 A |

FOREIGN PATENT DOCUMENTS

| | | | |
|---|---|---|---|
| 731243 | 2/1943 | Fed. Rep. of Germany | 139/383 A |
| 1822 | of 1892 | United Kingdom | 139/412 |
| 1207446 | 9/1970 | United Kingdom | 139/383 A |
| 1220531 | 1/1971 | United Kingdom | 139/383 A |

*Primary Examiner*—James Kee Chi

*Attorney, Agent, or Firm*—Brady, O'Boyle & Gates

[57] ABSTRACT

In order to reduce the rate of wear of a papermakers fabric having a loop seam, especially in the region of such loop seam, a protective facing of additional cross-machine direction yarns is provided at the intended roller side of the fabric. The additional yarns are woven integrally with the fabric and are arranged to float at the face of the fabric, and define a surface to the fabric as a whole which is displaced outwardly of the fabric in relation to the surface of the basic weave structure.

21 Claims, 15 Drawing Figures

| WARP YARN No. | 12 | 11 | 10 | 9 | 8 | 7 | 6 | 5 | 4 | 3 | 2 | 1 | |
|---|---|---|---|---|---|---|---|---|---|---|---|---|---|
| | | X | X | X | | X | X | X | | X | X | X | 1 |
| | | | | X | | | | X | | | | X | 2 |
| | | | | | | | | | | | | X | 3 |
| | | | | | | | X | | | | | | 4 |
| | X | | X | X | X | | X | X | X | | X | X | 5 |
| | | | X | | | | X | | | | X | | 6 |
| | | | X | | | | | | | | | | 7 |
| | | | | | | | | | X | | | | 8 |
| | X | X | X | | X | X | X | | X | X | X | | 9 |
| | X | | | | X | | | | X | | | | 10 |
| | X | | | | | | | | | | | | 11 |
| | | | | | | X | | | | | | | 12 |
| | X | X | | X | X | X | | X | X | X | | X | 13 |
| | | X | | | | X | | | | X | | | 14 |
| | | | | | | | | | | X | | | 15 |
| | | | | X | | | | | | | | | 16 |

WEFT YARN No

PAPERMAKERS FABRICS

The invention concerns papermakers fabric, and has more particular reference to a method for improving the abrasion resistance thereof.

In the papermaking process, a liquid suspension of cellulosic fibres is applied to a moving openwork mesh through which excess liquid is drained to give a moist web of cellulosic fibres and such filler or other materials as are appropriate to the paper being produced, the web subsequently passing through a roller nip whereat further liquid is removed, and eventually passing over heated rollers whereat the paper is dried.

The openwork mesh originally comprised a woven metal mesh, particularly phosphor bronze, but for some years past synthetic materials have been used and 'wires' of synthetic textile material are now commonplace.

One problem met with in connection with all woven wires has been the necessity to provide such wires in an endless belt form on the papermaking machine, this requiring that the wire be woven endless and applied to the machine in such form or that the wire be woven flat and the ends joined before or after application to the machine.

The present invention is directed to flat woven wires and is particularly concerned with a wire which can be easily joined after its mounting into the paper machine.

The formation of a seam by weaving the machine direction yarns back into the cloth thereby leaving a series of loops at either end of the fabric is well known. One major problem which has been found in practice with using a warp loop seam is that, as it is subjected to abrasion in use, the loops quickly disintegrate and the effective life of the fabric is correspondingly shortened.

It is an object of this invention to produce a fabric in which the problem of abrasion or seam failure is of reduced proportions, and thus, in accordance with the invention there is proposed a flat-woven papermakers fabric having integrally formed warp loops including additional cross-machine direction yarns at one face thereof and at least in the region of the fabric ends, the said additional cross-machine direction yarns lying or extending outwardly of the plane of the seam-forming elements at such face and floating at such face in relation to the normal weave structure thereof.

The invention will now be described further, by way of example only, with reference to the accompanying drawings in which.

Figures 1, 3:
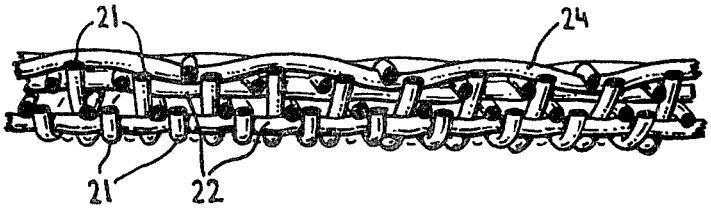
FIG. 1 is a transverse cross-section taken through a papermakers fabric embodying the invention.
FIG. 3 is a weave peg plan for the fabric of FIGS. 1 and 2.

FIGS. *4a* to *4l* are diagrams illustrating the paths of the individual warp yarns of a repeat, in accordance with the peg plan of FIG. 3.

Figure 2:
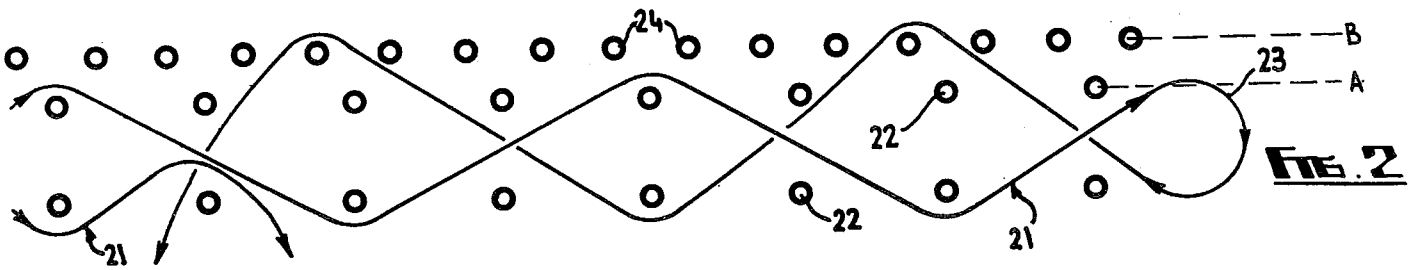
FIG. 2 is a longitudinal sectional view of an end region of a papermakers fabric constructed in accordance with the invention and showing a single, loop-forming yarn.
Figure 4A:
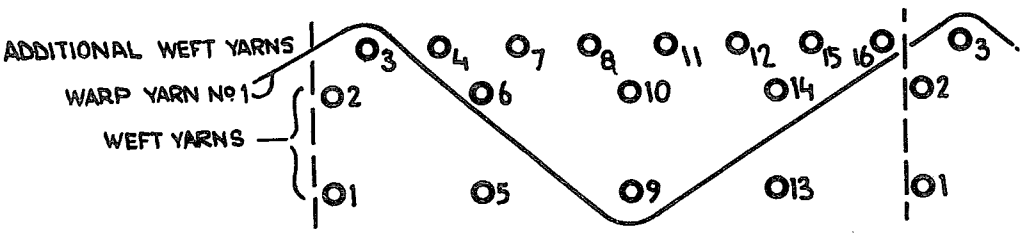
Figure 4B:
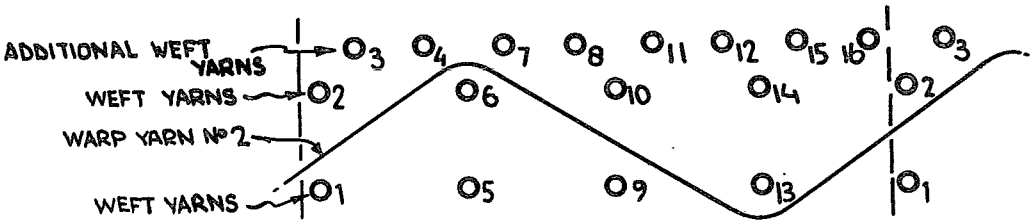
Figure 4C:
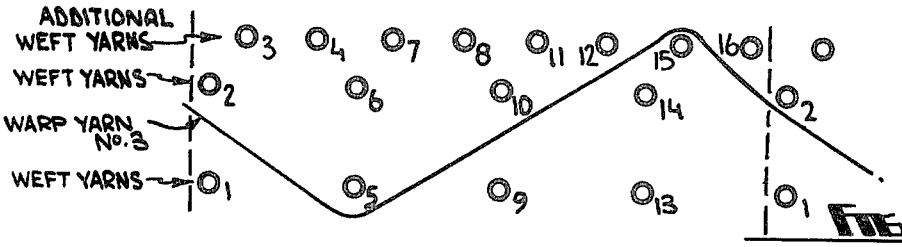
Figure 4D:
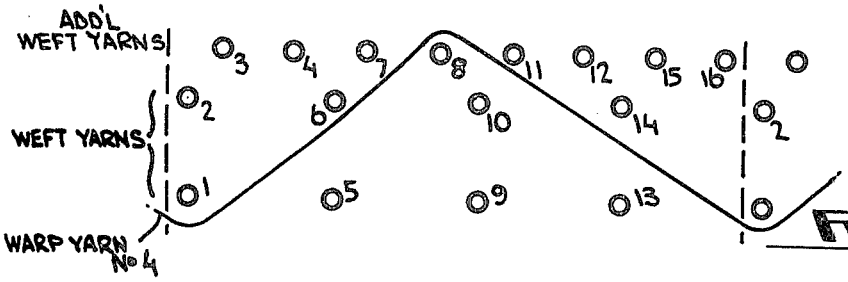
Figure 4E:
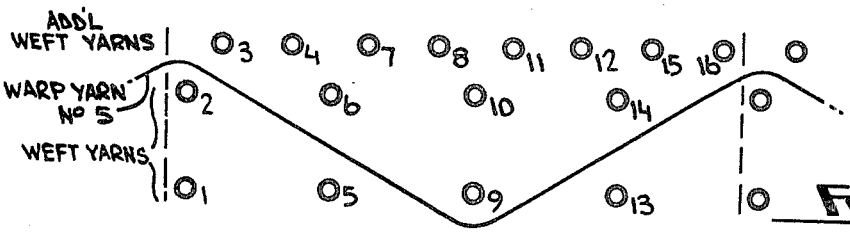
Figure 4F:
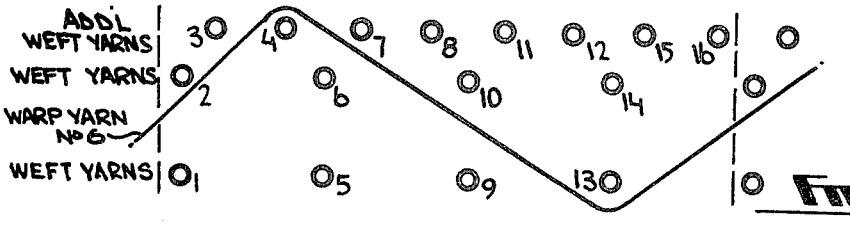
Figure 4G:
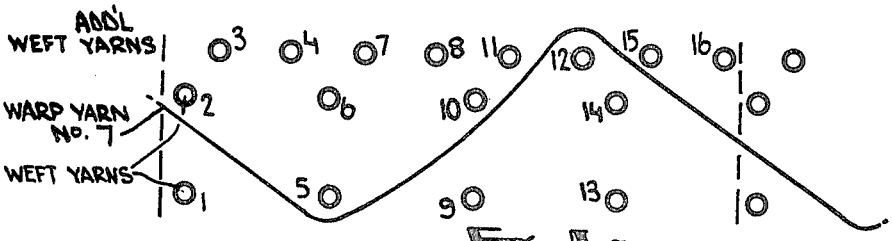
Figure 4H:
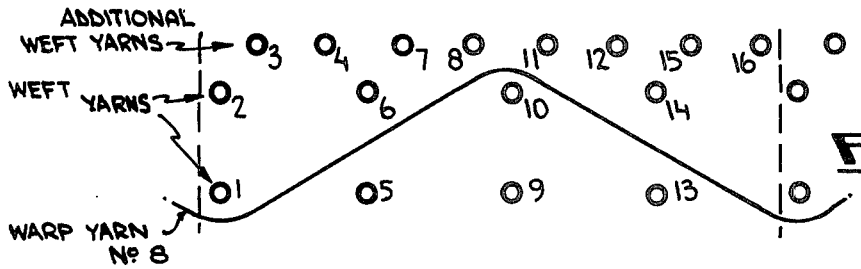
Figure 4I:
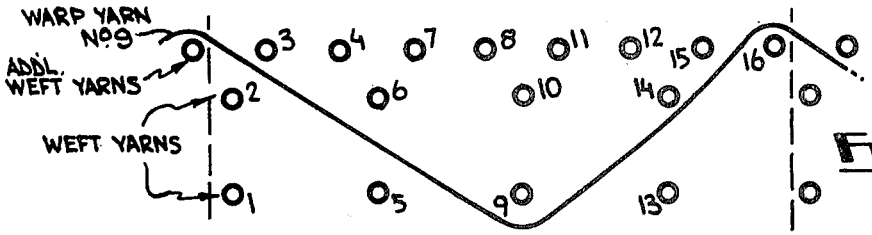
Figure 4J:
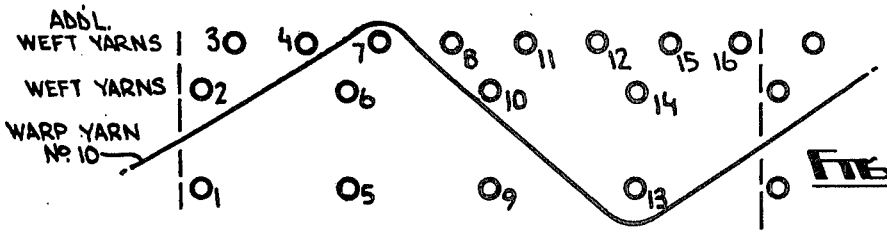
Figure 4K:
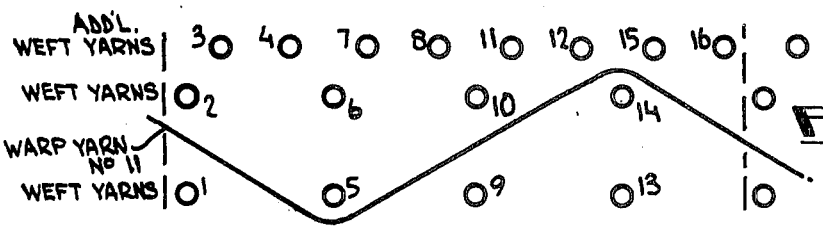
Figure 4L:
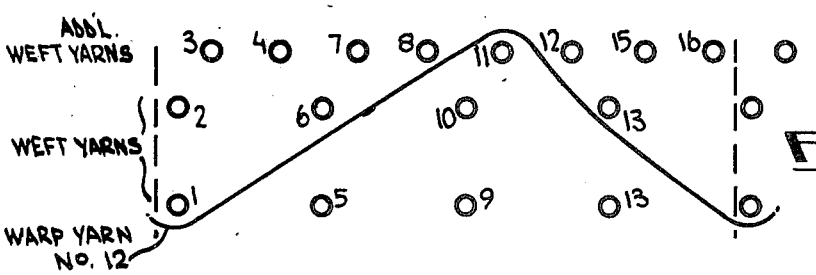

Referring now to the drawings, and particularly to FIGS. 1 and 2 thereof, a flat-woven papermakers fabric of known duplex or semi-duplex weave structure comprising warp yarns 21 and weft yarns 22, having warp loops 23 extending from the ends thereof whereby such ends might be joined together to form a seam, further includes additional weft yarns 24 at one or other face of the fabric, such yarns 24 floating at the surface of the fabric and being woven with, say, every twelfth warp yarn, and, in the embodiment illustrated, being provided on the basis of one additional weft yarn for each weft yarn ordinarily present in the structure. The additional weft yarns 24 will generally be provided throughout the full longitudinal extent of the fabric and will ordinarily be selected, as to their characteristics, to reduce wear during use of the fabric on a papermaking machine. However, it may be found sufficient, as regards protecting the region of the seam against wear, to provide additional weft yarns only in the region of the fabric ends, the extreme additional weft yarn in either case, being closely adjacent to such ends. The yarns 24 will preferably have, for example, an inherent high wear-resistance or an anit-slip characteristic, although such characteristics may be derived from a suitable resin or other treatment to which the yarn is subjected. It is not necessary, however, that the additional weft yarns have a wear-resistance beyond that of the other yarns of the fabric since the invention relies upon the fact that, whereas when a warp loop seam is made on the end of the fabric the warp loops lie substantially in the same plane as the body of the fabric, the provision of additional weft yarns as hereinproposed will result in the backs of the loops being in a plane A displaced inwardly of the total fabric in relation to the plane B of the back of such total fabric, the seam thereby being protected by the additional weft yarns, and particularly by the mass of such additional weft yarns.

The additional weft yarns will ordinarily be of a diameter (or equivalent) not greater than that of the weft yarns ordinarily present in the fabric, and may comprise yarns conventionally used in the art. Thus, resin coated monofilament or multifilament synthetic yarns, uncoated such yarns, glass yarns or metal yarns may be utilised.

The warp loops 23 are preferably formed in accordance with the disclosure of the specification of prior U.S. Pat. No. 4,026,331 wherein weft yarns are removed from the end of the fabric to give a weft free zone, selected ones of the warp yarns in the region of the weft free zone are shortened while the remaining warp yarns are folded back into register with respective ones of the shortened warp yarns selectively about one or other of the two axes extending transversely of the fabric to form loops spaced transversely of the fabric, and reintroducing weft yarns into the resultant weftless end of the fabric, the crimp pattern present in the uncut warp yarns being compatible with the overall crimp pattern of the volume of the fabric when such yarns are folded back about one or other of the said axes.

A typical fabric structure is shown in FIGS. 3 and 4, FIG. 3 being a weave peg-plan showing the shedding of the warp yarns for a pattern repeat of the total structure widthwise of the fabric of twelve ends and lengthwise of the fabric of sixteen picks and FIGS. *4a* to *4l* showing the relationship between the individual ones of the warp yarns 1 to 12 of the peg-plan of FIG. 3 and the individual weft yarns 1 to 16 of such peg-plan.

Thus, as can be seen from the right hand column of the peg-plan and from FIG. *4a*, warp yarn 1 is lifted for picks 1 to 3, is lowered for pick 4, raised again for pick 5, lowered for picks 6 to 12, raised for pick 13 and then lowered for picks 14 to 16, the yarn then being raised for picks 1 to 3 of the next repeat.

Similarly, the peg-plan and FIG. *4b* show that warp yarn 2 is lifted for the insertion of weft yarn 1, lowered for picks 2 to 4, raised again for picks 5 and 6, lowered for picks 7 and 8, raised for pick 9, and then lowered for picks 10 to 16 before being raised again for pick 1 of the next repeat.

The paths of warp yarns 3 to 12 are shown in the relevant columns of the peg-plan of FIG. 3 and in FIGS. 4*c* to 4*l*, respectively.

Reference to FIG. 3 will show that each of the additional weft yarns, which yarns comprise wefts 3, 4, 7, 8, 11, 12, 15 and 16 of the peg-plan, binds with the fabric as formed by the warp yarns 1 to 12 and the remaining weft yarns only once in each three pattern repeats of the base weave in the weftwise direction of the fabric.

It can be clearly seen from FIGS. 1 and 2 of the drawings how the plane of the cross machine direction yarns, as constituted by the additional weft yarns, lies substantially outside that of the machine direction loops forming the seam.

The invention is not restricted to the exact features of the embodiment herein described and illustrated, since alternatives will readily present themselves to one skilled in the art. Thus, whilst it is found preferable to provide additional weft yarns in like numbers in relation to the weft yarns ordinarily present, a lesser density of such additional weft yarns may be found satisfactory in some circumstances, although a ratio of additional weft yarns to weft yarns oridinarily present of less than 1 to 2 is thought unlikely to provide a substantial improvement in wear resistance. The extent to which the additional weft yarns float at the fabric surface may vary to suit particular circumstances, but ideally the additional weft yarns float over three repeats of the base weave, although arrangements wherein the float is over two or more than three such repeats are satisfactory.

The invention is applicable both to forming fabrics and to dryer fabrics, and may be used in the context of both single layer and multi-layer fabrics.

In the case of a papermakers fabric for use as a paper machine wire or a forming fabric (which expressions are, in this specification, to be considered to be synonymous), the additional weft yarns will be provided at the intended roller side of the fabric, whereas, bearing in mind that advantage has been found to stem from the provision of additional weft yarns at the paper side of a dryer fabric in that a better paper-forming surface is obtained by so doing, in the case of dryer fabrics the additional weft yarns will ordinarily be provided at such paper side and will preferably comprise spun yarns.

What I claim is:

1. A flat-woven papermakers fabric including a base weave structure comprised of cross-machine direction weft yarns and machine direction warp yarns and having integrally formed warp loops formed in a selected number of machine direction warp yarns and including additional cross-machine direction weft yarns at one face thereof and at least in the region of the ends of said fabric which are adapted to form a seam thereat, the said additional cross-machine direction weft yarns lying or extending outwardly of the plane of said seam at said face and floating at said face in relation to the base weave structure thereof by being periodically attached at selected locations to the base weave structure by a selected number of said warp yarns.

2. A papermakers fabric as claimed in claim 1, wherein the said additional cross-machine direction weft yarns are provided throughout the full longitudinal extent of the fabric in the machine direction.

3. A papermakers fabric as claimed in claim 1, wherein the additional cross-machine direction weft yarns float at the face of the fabric over at least three repeats of the base weave structure in the cross-machine direction.

4. A papermakers fabric as claimed in claim 1, wherein the diameter, or equivalent, of the additional cross-machine direction weft yarns does not exceed that of the cross-machine direction weft yarns of the base weave structure.

5. A papermakers fabric as claimed in claim 1, wherein the additional cross-machine direction weft yarns are provided in equal numbers relative to the cross-machine direction weft yarns of the base weave structure.

6. A papermakers fabric as claimed in claim 1, wherein the additional cross-machine direction weft yarns are provided on the basis of at least one additional weft yarn for each two cross-machine direction yarns of the base weave structure.

7. A papermakers fabric as claimed in claim 1, wherein the additional cross-machine direction weft yarns are provided at a location directly adjacent to the ends of said fabric.

8. A papermakers fabric as claimed in claim 1, wherein the additional cross-machine direction weft yarns define a plane spaced outwardly of the fabric in relation to the plane of the adjacent surface of the base weave.

9. A papermakers fabric as claimed in claim 1, wherein said base weave structure includes a roller side and the additional cross-machine direction weft yarns are located on the roller side of the base weave structure.

10. A papermakers fabric as claimed in claim 1, wherein said base weave structure includes a paper side and the additional cross-machine direction yarns are located on the paper side of the base weave structure.

11. A papermakers dryer fabric as claimed in claim 10, wherein the additional cross-machine direction weft yarns are spun yarns.

12. A papermakers fabric as claimed in claim 1, wherein additional cross-machine direction weft yarns are provided at each face of the base weave structure.

13. A papermakers fabric as claimed in claim 1, wherein the base weave comprises a semi-duplex fabric weave structure.

14. A papermakers fabric as claimed in claim 13, wherein the base weave structure comprises a 3 and 1 twill structure.

15. A papermakers fabric as claimed in claim 1, wherein the additional cross-machine direction weft yarns comprise synthetic yarns.

16. A flat-woven papermakers fabric having a paper side and comprising a semi-duplex base weave structure of machine direction warp yarns and cross-machine weft yarns, having additional cross-machine direction weft yarns at the paper side thereof, the said additional weft yarns being provided on the basis of one such yarn for each cross-machine direction weft yarn and floating at the surface of the paper side over three repeats of the base weave structure to define a plane spaced outwardly of the fabric in relation to the plane of the said surface of said base weave structure.

17. A flat-woven papermakers fabric having a base weave structure comprised of cross-machine direction weft yarns and interweaving machine direction warp yarns, and including additional cross-machine direction weft yarns on one face thereof, said additional cross-machine direction weft yarns being in floating relationship with said base weave structure, said floating relationship being a configuration whereby each additional cross-machine direction weft yarn is held in position by selectively different ones of said machine direction warp yarns at correspondingly different locations spaced in the cross-machine direction of said base weave structure.

18. The flat-woven papermakers fabric as claimed in claim 17 wherein said base weave structure is comprised of at least two layers of cross-machine direction weft yarns interwoven with machine direction warp yarns.

19. The flat-woven papermakers fabric as claimed in claim 17 wherein one face of said base weave structure has a paper forming surface and wherein said additional cross-machine direction weft yarns are located on an opposite face relative to said one face, said additional cross-machine direction weft yarns defining a support surface at said opposite face which is at least coplanar and preferably lies outwardly thereof.

20. The flat-woven papermakers fabric as claimed in claim 19 wherein said base weave structure includes two layers of cross-machine direction weft yarns.

21. A flat-woven papermakers fabric comprising at least one layer of cross-machine direction weft yarns interwoven with machine direction warp yarns to provide a base weave structure, there being outwardly extending loops at the fabric ends formed from selected machine direction warp yarns of said base weave structure, and a plurality of additional cross-machine direction weft yarns at least on one face of said base weave structure, said additional cross-machine direction weft yarns defining a support surface at said one face which is outwardly thereof, the individual ones of said plurality of additional cross-machine weft yarns floating in relation to the base weave structure and being held in position thereon, the ratio of the total number of machine direction warp yarns across which a given additional cross-machine direction weft yarn extends to the number of points at which said given cross-machine direction weft yarn is held in position on the base weave structure being not less than 4:1.

* * * * *